United States Patent [19]

Smith

[11] 4,068,872

[45] * Jan. 17, 1978

[54] LATCHED CABINET STRUCTURE

[76] Inventor: Charles V. Smith, 24120 Dunlap Road, Bothell, Wash. 98011

[ * ] Notice: The portion of the term of this patent subsequent to Sept. 14, 1993, has been disclaimed.

[21] Appl. No.: 657,159

[22] Filed: Feb. 11, 1976

[51] Int. Cl.[2] ..... E05C 19/06

[52] U.S. Cl. ..... 292/87; 292/255; 312/213

[58] Field of Search ..... 292/17, 76, 80, 81, 292/82, 83, 84, 85, 86, 87, 88, 89, 90, 91, 254, 255; 312/215, 222; 333, 319

[56] References Cited

U.S. PATENT DOCUMENTS

| | | | |
|---|---|---|---|
| 654,791 | 7/1900 | Graf | 292/87 UX |
| 1,094,773 | 4/1914 | Beehler | 292/254 X |
| 1,227,590 | 5/1917 | Deindoerfer | 292/87 |
| 1,293,347 | 2/1919 | Corwin | 292/87 X |
| 1,732,940 | 10/1929 | Larson | 292/17 X |
| 1,882,536 | 10/1932 | Weinheimer | 292/255 |
| 2,106,642 | 1/1938 | Mathews | 292/255 X |
| 2,735,740 | 2/1956 | Soans | 292/254 X |
| 3,313,564 | 4/1967 | Pultz | 292/87 |
| 3,801,143 | 4/1974 | Gutner | 292/76 |

FOREIGN PATENT DOCUMENTS

| | | | |
|---|---|---|---|
| 1,121,697 | 5/1956 | France | 312/319 |
| 499,439 | 1/1939 | United Kingdom | 312/319 |

*Primary Examiner*—Marion Parsons, Jr.
*Assistant Examiner*—Thomas J. Holko

[57] ABSTRACT

A latched cabinet structure includes obscure toe-pressed means operable to disengage latching means securing the cabinet door.

2 Claims, 2 Drawing Figures

LATCHED CABINET STRUCTURE

BACKGROUND AND SUMMARY OF THE INVENTION

Throughout the years a wide variety of cabinet door latches have been developed for the purpose of keeping the doors closed but readily releasable, sometimes by an opening pull on them. Such latches may involve magnetically-engaged or frictionally-engaged parts between the door and the cabinet. Often they employ interengaged mechanical means, as where a pair of lips or jaws are engaged. Some of the latch means have been operable by merely exerting an outward pull on the door to open the cabinet. Other systems employ an external unlatching operator button or the like which requires manual dexterity.

It has been common experience that small children are fascinated with opening and closing cabinet doors and such latches. Young children soon solve the mysteries of the latching systems, which means that they then have ready access to the contents of the cabinet. It is a primary purpose of this invention to provide latched cabinet structure, the unlatching of which is unobtrusively accomplished by the use of a person's foot or toe and which operation is obscured from the child at the floor level and, further, which is accomplished by imparting a thrusting pressure in a direction and at a location not normally within the skill or in the view of small children. It is a further objective of this invention to provide latching structure for cabinets that is capable of inexpensive manufacture and which may be easily installed for proper operation by mechanically unskilled persons, usually requiring only the use of a common screwdriver.

These and other objects and advantages of this invention will be understood from the Detailed Description in this specification.

DESCRIPTION OF THE INVENTION

Figure 1:
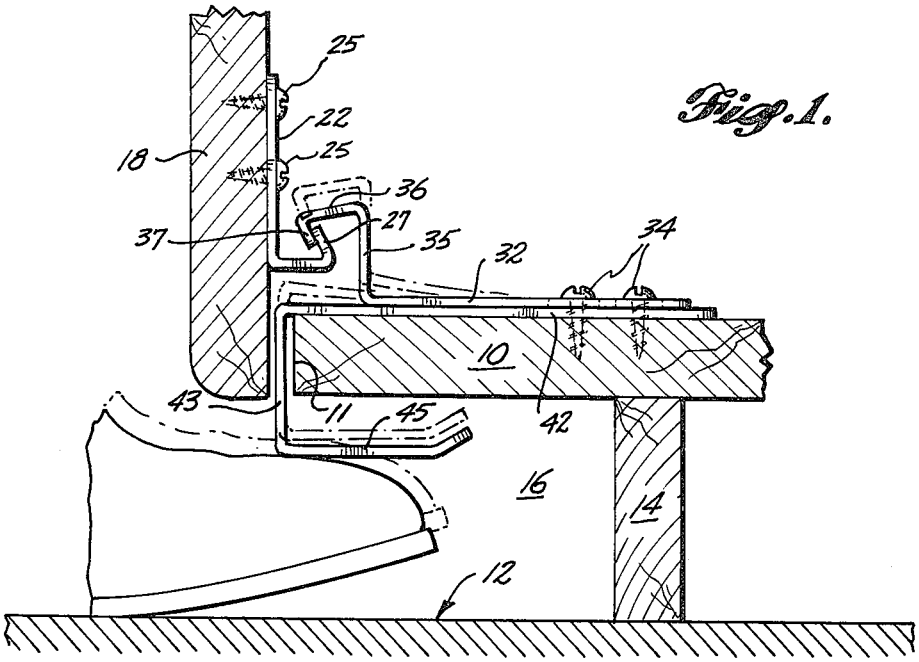
FIG. 1 is a fragmentary, vertical, cross-sectional view of a cabinet lower-front portion embodying this invention.

In FIG. 1 is shown lower portions of a conventional cabinet often found in kitchens, bathrooms and the like. Bottom shelf 10 is supported above the floor 12 by stringer 14. Kick space 16 is formed by surfaces of the floor 12, stringer 14 and the underside of shelf 10, and is usually about 3 to 3½ inches high and about 3 to 4 inches deep. Its purpose is to accommodate the toes of a person standing close to the cabinet front. Door 18 closes the cabinet front. Such doors are usually hinged at a side edge (not shown) to swing away from and toward the front edge of shelf 10 as the cabinet space is opened or closed.

The latch/catch mechanism comprises the strike device 20, the tang 30 and the lifter arm 40. All parts are preferably formed from thin metal strap material about ½ to ¾ of an inch wide.

Strike device 20 includes the upright mounting plate 22 perforated at 23, 24 to receive screws 25 to attach the device on the inside of door 18. The instanding arm 26 carries catch lip 27 in a position where it overlies the shelf 10 when door 18 is closed. The front face of lip 27 is associated with arm 26 at an acute angle to provide a wedging or lifting action as the door is being closed.

Figure 2:
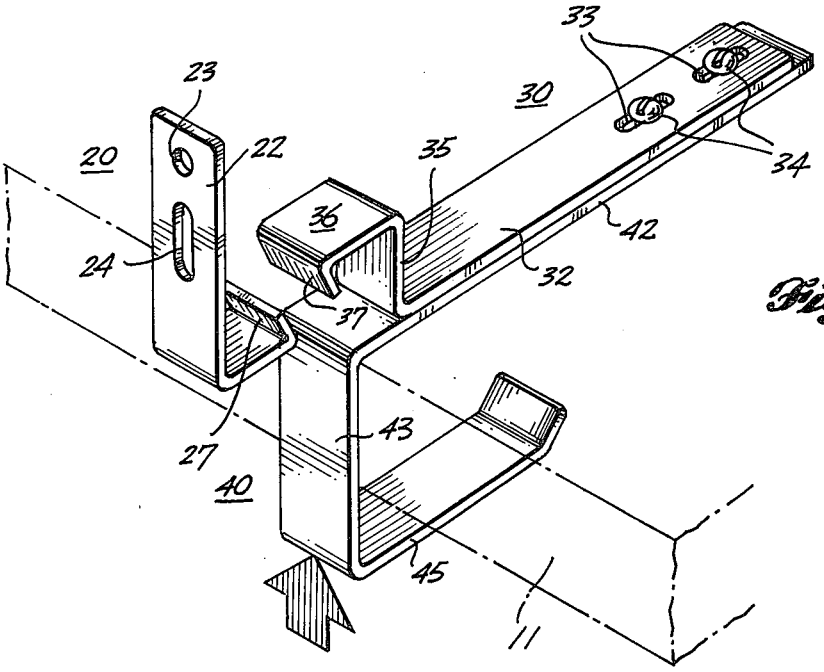
FIG. 2 is a perspective view of the latch/catch mechanism of this invention.

The latching tang 30 is elongated, as shown particularly in FIG. 2, and comprises the flexible arm 32 perforated at 33 to receive screws 34 whereby the tang is attached securely to the upper face of shelf 10. Arm 32 has upstanding member 35 which supports the forward-extending offset arm 36 that in turn supports the downstanding jaw latch 37. Preferably latch 37 is canted and, being mounted in the path of strike device 20, is engaged by lip 27 as the door is closed. The engagement of latch 27 with lip 37 results in the latter being first displaced upward, the arm 32 being flexed or bowed, until lip 27 is behind latch 37, whereupon the two parts interengage and the door is latched.

Unlatching or disengagement of parts 27 and 37 is accomplished by lifter arm 40. Arm 40 comprises the rearwardly anchored shank 42. Screws 34 secure shank 42 beneath tang 30. Shank 42 extends to the front edge 11 of shelf 10 where leg 43 depends from and terminates in kick space 16. An upward thrust on leg 43 causes shank 42 and flexible arm 32 to bow upward to thereby disengage latch 37 from catch 27 and release door 18. The application of upward pressure on leg 43 is facilitated by foot 45 which provides greater surface for toe contact. Foot 45 is spaced sufficiently beneath shelf 10 to insure that parts 27 and 37 are disengaged before the shelf prevents further upward movement.

The installation of the latching means is a relatively simple matter. Usually the tang arm 32 and the shank 42 are initially anchored in place by the insertion of screws 34 through elongated openings 33, 33. These parts may be shifted forward or rearward until the latch or jaw 37 is appropriately spaced relative the front edge 11 of the shelf. The strike device 20 is attached to the inside of the door, its elongated slot being first used for the insertion of a screw 25 into the door. The strike device is then adjusted vertically so that it is appropriately related for automatic latching engagement as between lip 27 and jaw latch 37. Then a second screw 25 may be passed through the opening 23 and both tightened to fixedly attach the strike device in the selected and adjusted position.

In compliance with the statute, the invention has been described in language more or less specific as to structural features. It is to be understood however, that the invention is not limited to the specific features shown, since the means and construction herein disclosed comprises a preferred form of putting the invention into effect. The invention is therefore claimed in any of its forms or modifications within the legitimate and valid scope of the appended claims, appropriately interpreted in accordance with the doctrine of equivalents.

What is claimed is:

1. In a cabinet or the like having a kick space beneath the front edge of the bottom shelf and a door panel hinged at one side edge to said cabinet and normally closing to said bottom shelf, substantially invisible latching mechanism for said door, comprising: an instanding strike device on the inside of said door panel, said strike device having an upstanding catch located to overlie the bottom shelf in spaced relation thereabove when the door is closed; an elongated latching tang is secured to the upper face of said shelf and disposed wholly inside the front edge of said shelf and, said tang including a downwardly-biased, forward-extending flexible arm supporting a downstanding jaw latch located to engage said catch to retain said door closed against said shelf edge, and unlatching means, comprising:

an upwardly movable, flexible lifter arm secured to said shelf in underlying relation to said flexible arm and operable upward in the space beneath said strike device to disengage said jaw latch from said catch;

said lifter arm extending forwardly past the front edge of said shelf; and a lifter leg depending from the forward portion of said lifter arm between said shelf front edge and the door closed thereto, said leg having a lower terminal in spaced relation to the underside of said shelf and accessible to be engaged by a user's toe applied with an upward thrust.

2. The structure according to claim 1 in which at the lower terminal of the lifter leg there is a rearward extending arm in said kick-space under said bottom shelf.

* * * * *